US007608019B1

(12) United States Patent
Stearns et al.

(10) Patent No.: US 7,608,019 B1
(45) Date of Patent: Oct. 27, 2009

(54) ELLIPTICAL EXERCISE METHODS AND APPARATUS

(76) Inventors: Kenneth W. Stearns, P.O. Box 55912, Houston, TX (US) 77255; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 11/998,075

(22) Filed: Nov. 28, 2007

(51) Int. Cl.
*A63B 22/06* (2006.01)
*A63B 22/00* (2006.01)

(52) U.S. Cl. ..... 482/52; 482/57; 482/70

(58) Field of Classification Search ..... 482/51, 482/52, 57, 70, 79, 80
See application file for complete search history.

(56) References Cited

U.S. PATENT DOCUMENTS

| | | | | |
|---|---|---|---|---|
| 5,762,588 | A * | 6/1998 | Chen | 482/57 |
| 5,779,599 | A * | 7/1998 | Chen | 482/57 |
| 5,967,944 | A | 10/1999 | Vittone | 482/52 |
| 6,277,055 | B1 | 8/2001 | Birrell | 482/52 |
| 6,514,180 | B1 | 2/2003 | Rawls | 482/70 |
| 6,875,160 | B2 | 4/2005 | Watterson | 482/57 |
| 6,949,053 | B1 | 9/2005 | Stearns | 482/52 |
| 7,041,034 | B1 | 5/2006 | Stearns | 482/52 |
| 7,303,509 | B2 | 12/2007 | Schroder | 482/52 |
| 7,513,854 | B1 * | 4/2009 | Stearns et al. | 482/52 |
| 2002/0155926 | A1 | 10/2002 | Lat | 482/52 |
| 2003/0216222 | A1 | 11/2003 | Kuo | 482/52 |
| 2005/0181911 | A1 * | 8/2005 | Porth | 482/52 |
| 2005/0272562 | A1 | 12/2005 | Alessandri | 482/52 |
| 2006/0046902 | A1 * | 3/2006 | Chang | 482/52 |
| 2006/0217235 | A1 * | 9/2006 | Schroder | 482/52 |
| 2008/0146417 | A1 | 6/2008 | Chang | 482/70 |

* cited by examiner

*Primary Examiner*—Steve R Crow

(57) ABSTRACT

An exercise machine has foot supporting linkages that link rotation of left and right cranks to movement of a person's feet through respective left and right elliptical paths of motion that include a component extending parallel to the crank axis.

12 Claims, 6 Drawing Sheets

ELLIPTICAL EXERCISE METHODS AND APPARATUS

FIELD OF THE INVENTION

The present invention relates to exercise methods and apparatus, and more specifically, to exercise machines that facilitate exercise movement through an elliptical path.

BACKGROUND OF THE INVENTION

A variety of exercise machines have been developed to generate elliptical foot motion. An object of the present invention is to modify such machines so that a user's feet are not constrained to travel in planes that are parallel to one another.

SUMMARY OF THE INVENTION

An aspect of the present invention is to facilitate movement of a person's left and right feet through respective, elliptical paths of motion that are not parallel to one another. Many features and advantages of the present invention will become apparent from the detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

An exercise machine constructed according to the principles of the present invention is designated as 100 in FIGS. 1-6. The machine 100 is similar in several respects to the exercise machine shown in FIGS. 31-32 in U.S. Pat. No. 6,171,215 to Stearns et al., which is incorporated herein by reference and may contribute supplemental information regarding elliptical motion exercise machines, as well as associated terminology and various design options. However, whereas the above-referenced prior art machine generates left and right elliptical foot paths in parallel left and right vertical planes, the apparatus 100 generates left and right foot elliptical foot paths that may be described as skewed relative to one another, and/or as having a lateral component.

Figure 1:
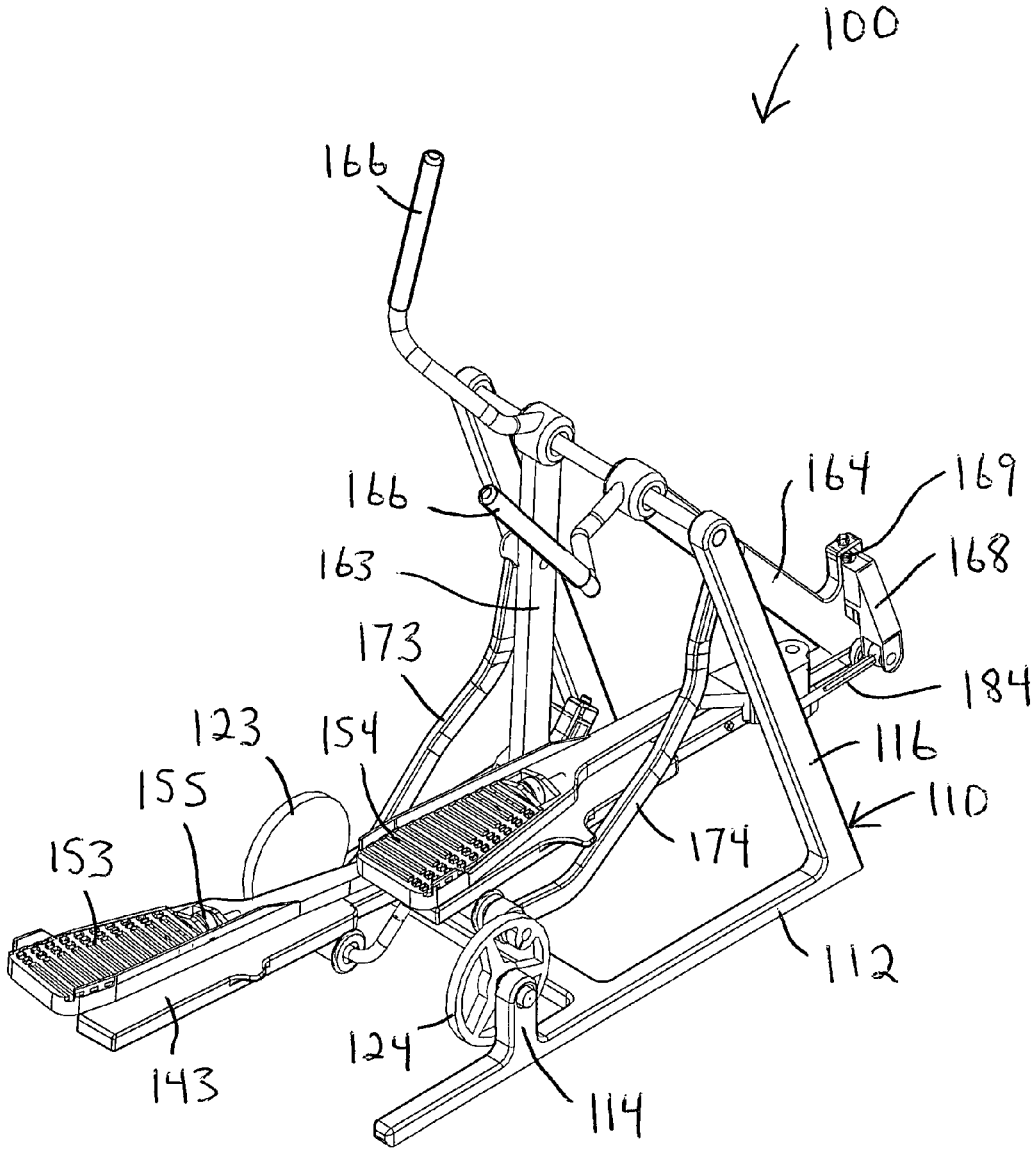
FIG. 1 is a perspective view of an exercise machine constructed according to the principles of the present invention.
Figure 2:
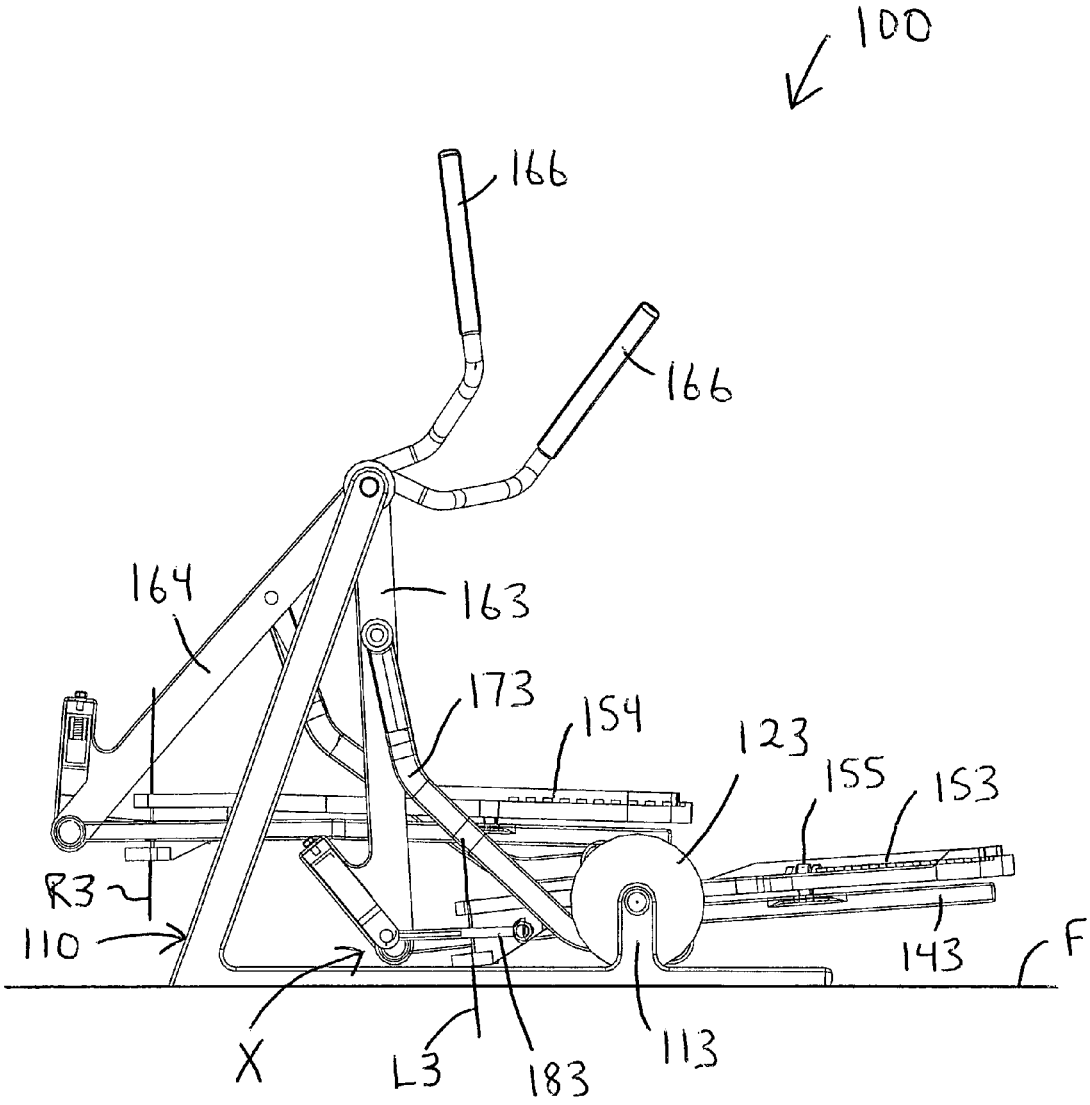
FIG. 2 is a left side view of the exercise machine of FIG. 1.
Figure 3:
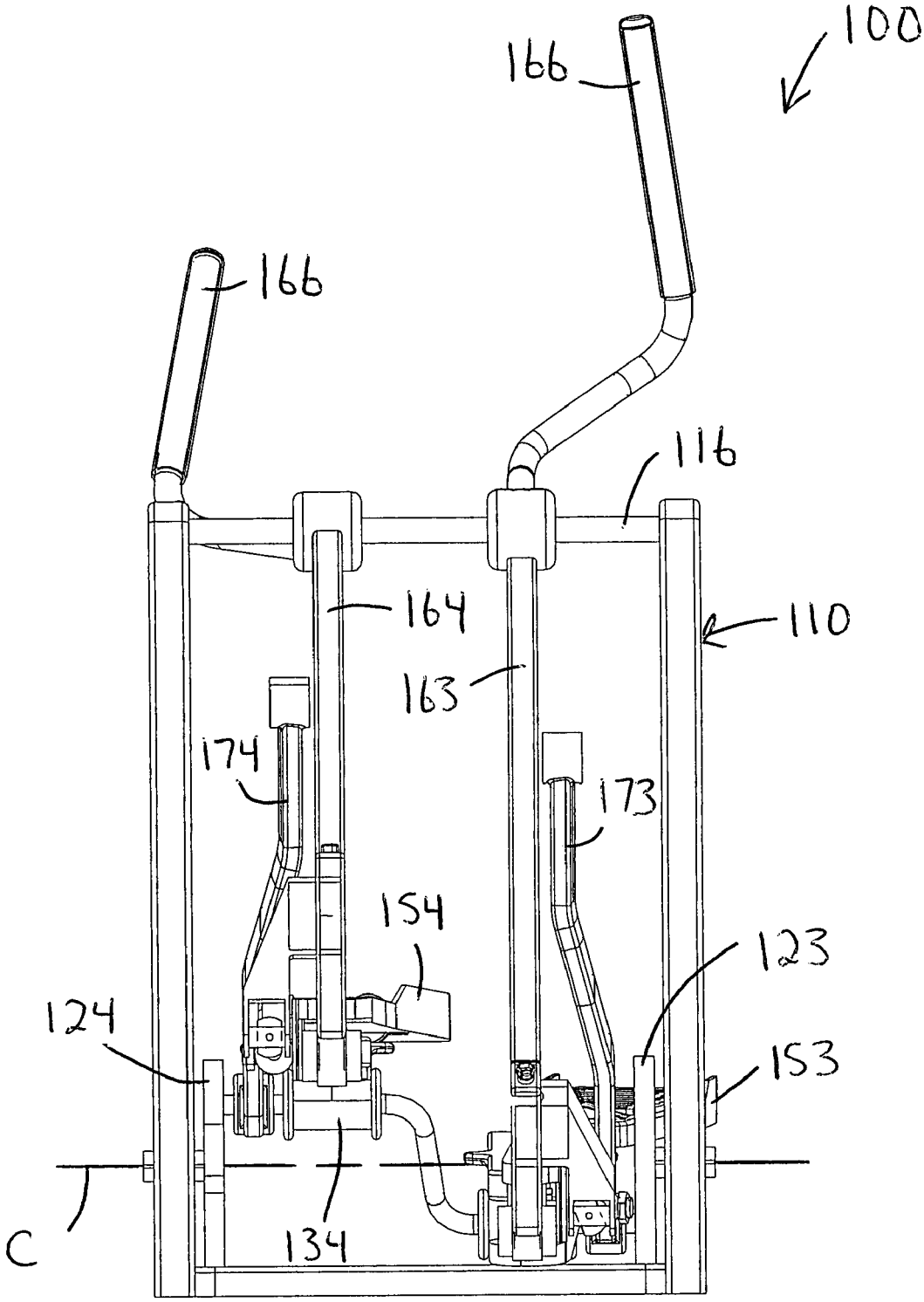
FIG. 3 is a front view of the exercise machine of FIG. 1.
Figure 4:
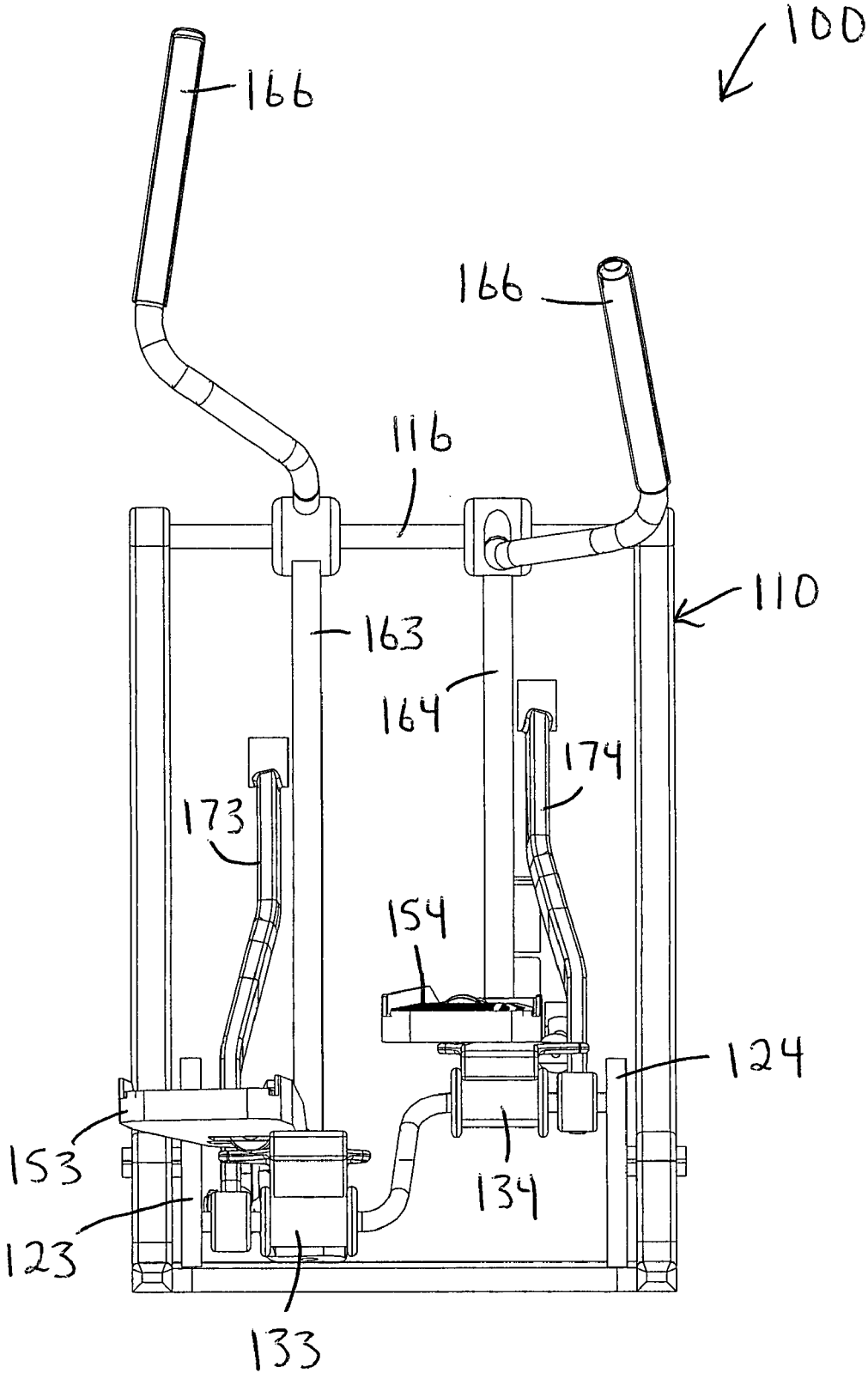
FIG. 4 is a rear view of the exercise machine of FIG. 1.

The machine 100 includes a frame 110 having a base 112 that is configured and arranged to rest in place on a horizontal floor surface F (see FIG. 2). Left and right rearward supports 113 and 114 extend upward from respective sides of the base 112 and support respective left and right cranks 123 and 124. A forward stanchion 116 extends upward from a forward portion of the base 112 and supports left and right rocker links 163 and 164. The forward stanchion 116 may be described as an inverted U-shaped member having a central rod that is preferably cylindrical.

The apparatus 100 is generally symmetrical about a vertical plane (designated as P in FIGS. 5 and 6) extending longitudinally through the base 112, the only noteworthy exception being the relative orientation of certain components on opposite sides of the plane of symmetry P (which are preferably one hundred and eighty degrees out of phase relative to one another). Thus, when reference is made to parts on a particular side of the apparatus 100, it is to be understood that similar parts are disposed on the opposite side of the apparatus 100. Also, to the extent that reference is made to "forward" or "rearward" portions of the apparatus 100, it is to be understood that a person may exercise on the apparatus 100 and/or a modified version of the apparatus 100 while facing in either direction relative to the frame 110.

The left crank 123 may be described in terms of a flywheel that is rotatably connected to the left crank support 113 for rotation about a crank axis C (see FIG. 3), and a left crank pin that is rigidly secured to the flywheel at a radial distance from the crank axis C. The right crank 124 may be described in terms of a crank wheel that is rotatably to the right crank support 114 for rotation about the same crank axis C, and a right crank pin that is rigidly secured to the right crank wheel at the same radial distance from the crank axis C. The left and right crank pins are diametrically opposed relative to the crank axis C and cooperate to define a crank diameter therebetween. A generally Z-shaped rigid bar is rigidly secured between the left crank pin and the right crank pin, thereby constraining the left and right cranks 123 and 124 to rotate together relative to the frame 110. Persons skilled in the art will recognize that other conventional inertia altering devices, including, for example, a motor, a "stepped up" flywheel, or an adjustable brake, may be operatively connected to one or both of the cranks 123 and 124 to affect rotational characteristics of the cranks 123 and 124.

Persons skilled in the art will also recognize that a user interface may be mounted on the machine 100, including the central portion of the forward stanchion 116, for example, in order to perform functions such as (1) displaying information to the user regarding items such as (a) exercise parameters and/or programs, (b) the current parameters and/or a currently selected program, (c) the current time, (d) the elapsed exercise time, (e) the current speed of exercise, (f) the average speed of exercise, (g) the number of calories burned during exercise, (h) the simulated distance traveled during exercise, and/or (i) internet data; and (2) allowing the user to (a) select or change the information being viewed, (b) select or change an exercise program, (c) adjust the speed of exercise, (d) adjust the resistance to exercise, (e) adjust the orientation of the exercise motion, and/or (f) immediately stop the exercise motion.

Figure 6:
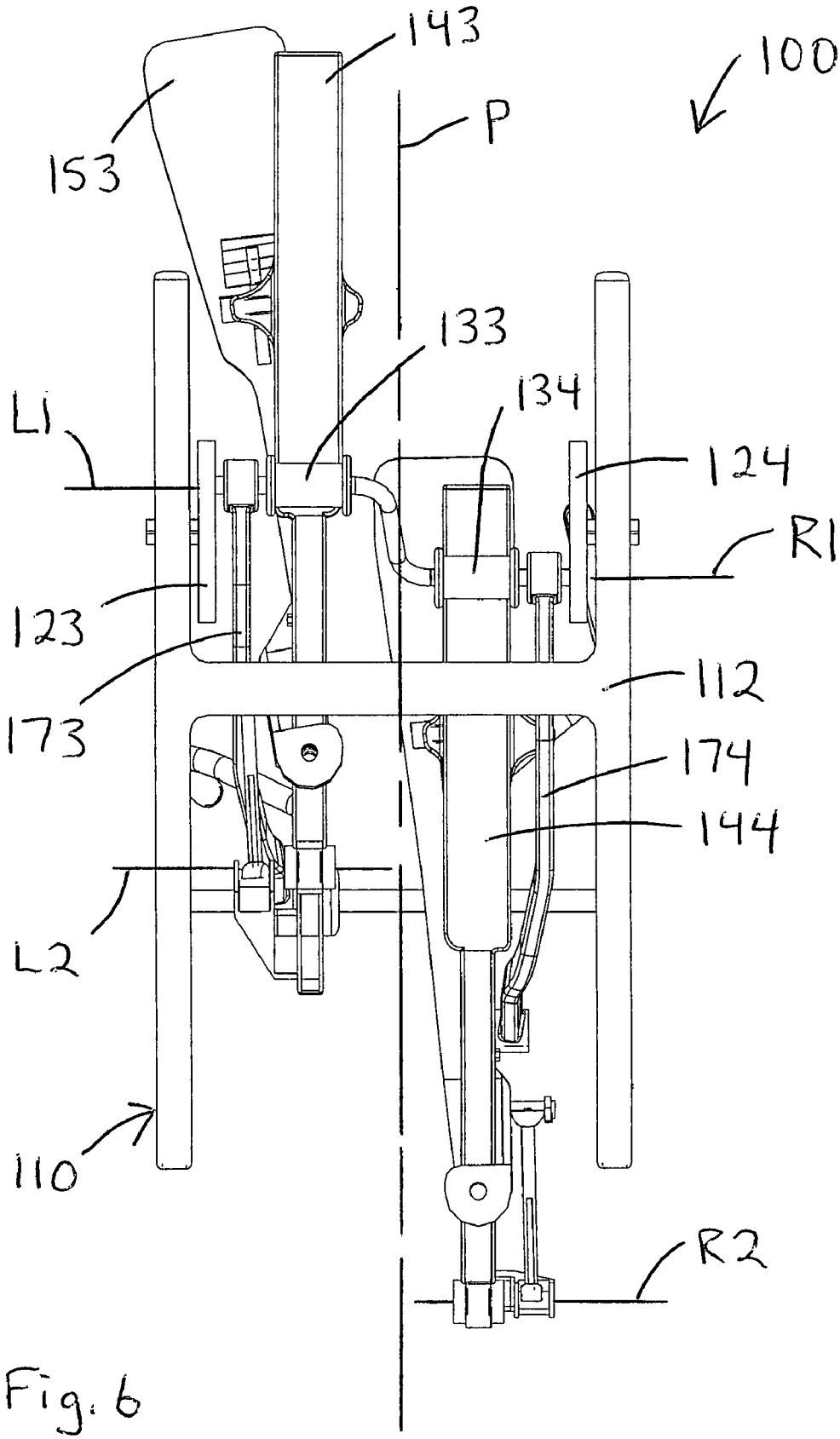
FIG. 6 is a bottom view of the exercise machine of FIG. 1.

As shown in FIG. 6, a left crank roller 133 is rotatably mounted on the left crank pin for rotation relative thereto about a roller axis L1, and a right crank roller 134 is rotatably mounted on the right crank pin for rotation relative thereto about a roller axis R1. Each roller axis L and R extends parallel to the crank axis C.

Left and right intermediate supports or rails 143 and 144 have forward portions that are pivotally connected to lower portions of respective left and right rocker links 163 and 164 for pivoting about respective axes L2 and R2 that extend parallel to the crank axis C. An upper portion of each rocker link 163 and 164 is pivotally connected to the central portion of the forward stanchion 116 for pivoting about a common pivot axis Z (see FIG. 5). Left and right handles 166 are secured to upper distal ends of respective rocker links 163 and 164 to guide a persons hands through reciprocal arcuate paths during rotation of the cranks 123 and 124.

The rails 143 and 144 have opposite, rearward portions that are configured to remain in rolling contact on top of respective crank rollers 133 and 134. Left and right foot supports 153 and 154 are movably supported on respective rails 143 and 144. More specifically, the foot supports 153 and 154 have forward portions that are pivotally connected to respective rails 143 and 144 for pivoting about respective axes L3 and R3 (see FIG. 2), which extend perpendicular to the crank axis C. The foot supports 153 and 154 have opposite, rearward ends that define respective upwardly facing bearing surfaces or foot platforms, which are configured to support a user's feet. Shields may be provided on opposing, inwardly facing sides of the foot platforms to shield a user's ankles against undesired contact with an opposite side foot support. Optional support rollers 155 are rotatably mounted on intermediate portions of the foot supports 153 and 154, and rollable across intermediate portions of respective rails 143 and 144. Persons skilled in the art will recognize that these rollers 155 are not required if the foot supports 153 and 154 are sufficiently rigid and sturdy.

Left and right drawbar links 173 and 174 have rearward ends rotatably connected to respective cranks 123 and 124, and forward ends rotatably connected to intermediate portions of respective rocker links 163 and 164. The drawbar links 173 and 174 cooperate with the other components described above to link rotation of the cranks 123 and 124 to movement of the rearward ends of the rails 143 and 144 through parallel, generally elliptical paths. On the preferred embodiment 100, the pivot locations of the drawbar links 173 and 174 are fixed relative to respective rocker links 163 and 164. However, as shown in the patent incorporated herein by reference, these pivot locations may be adjusted along the rocker links 163 and 164 to alter the elliptical paths traversed by the rearward ends of the rails 143 and 144.

Left and right drawbar links 183 and 184 are interconnected between respective foot platforms 153 and 154 and respective rocker links 163 and 164 (via ball and socket joints that accommodate universal pivoting therebetween). The drawbars 183 and 184 control the extent to which the foot platforms 153 and 154 pivot laterally relative to respective rails 143 and 144. The drawbars 183 and 184 are connected to respective slide blocks 168, which in turn, are slidably mounted on respective rocker links 163 and 164. Lead screws 169 are operatively interconnected between respective rocker links 163 and 164 and respective slide blocks 168 to selectively reposition respective ball joint centers relative to respective pivot axes L2 and R2 (as shown in the region identified as X in FIG. 2). In other words, the lead screws 169 cooperate with respective slide blocks 168 to provide means for adjusting each said second drawbar relative to a respective said rocker link. Other known adjustment methods may be used on alternative embodiments. For example, linear actuators may be used in lieu of the lead screws 169. Alternatively, springs and/or dampeners may be substituted for the lead screws 169 to make the lateral motion adjustable in response to user applied force.

Figure 5:
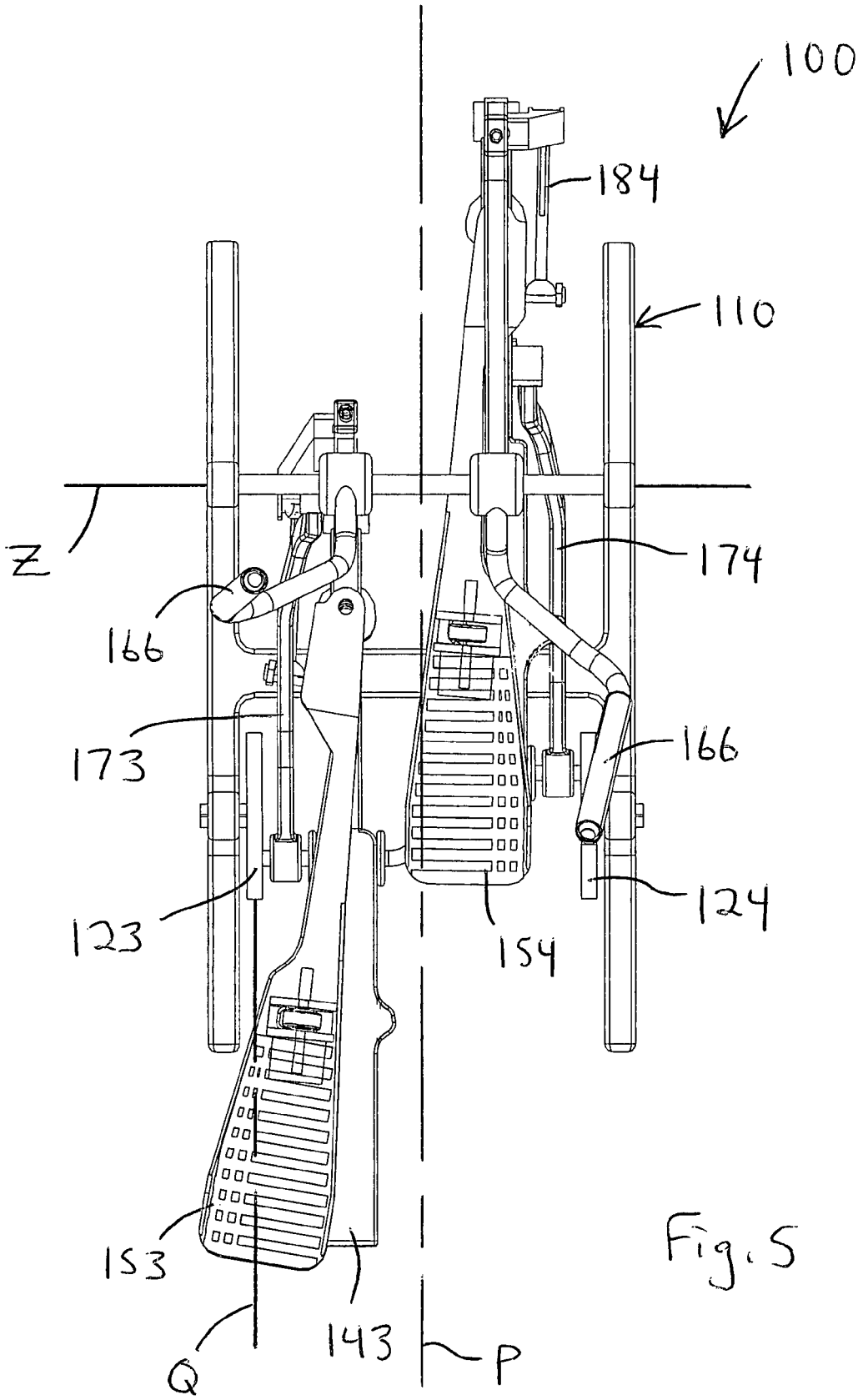
FIG. 5 is a top view of the exercise machine of FIG. 1.

Generally speaking, the drawbars 183 and 184 link (a) changes in angles between the rocker links 163 and 164 and respective rails 143 an 144, as measured perpendicular to respective pivot axes L2 and R2, to (b) changes in angles between the foot platforms 153 and 154 and respective rails 143 and 144, as measured perpendicular to respective pivot axes L3 and R3. If the ball joint centers are aligned with respective rocker link axes L2 and R2, then the foot platforms 153 and 154 move through parallel elliptical paths (with no lateral motion). Movement of the ball joint centers to positions out of alignment with the rocker link axes L2 and R2 results in pivotal displacement of the foot platforms 153 and 154 about axes L3 and R3 relative to respective rails 143 and 144 during operation of the apparatus 100. In other words, the resulting elliptical foot paths are not longer parallel to one another. The greater the deviation from alignment, the greater the resulting lateral motion. As shown in FIGS. 5 and 6, where the machine is configured as shown in FIG. 2, not much displacement of the ball joint centers is required in order to move the foot platforms 153 and 154 through paths that extend across the plane of symmetry P, and/or across a crank-defined plane Q extending through a crank 123 or 124 and perpendicular to the crank axis C.

The preferred embodiment 100 is shown with left and right rails 143 and 144 and left and right foot supports 153 and 154. On an alternative embodiment, unitary foot supporting rails are substituted for the rails 143 and 144 and foot supports 153 and 154. Under such circumstances, the forward ends of the unitary foot supporting rails are movably connected to respective rocker links by ball and sockets or other universal joints. Also, substitute crank rollers are provided to accommodate lateral movement of the unitary foot supporting rails relative thereto, in addition to rolling movement on top thereof. The same sort of slide block arrangement may be used to selectively reposition the ball joint centers of the drawbar links 183 and 184 relative to the universal joint centers.

The term "foot supporting arrangements" may be used to describe both the unitary foot supporting rails described with reference to the alternative embodiment, and the combinations of rails 143 and 144 and foot platforms 153 and 154 on the preferred embodiment 100. Also, the present invention may be described in terms of an otherwise conventional elliptical motion exercise machine having left and right elliptical path generating assemblies operatively interconnected between a frame and respective left and right cranks rotatably mounted on the frame, and modified to move a user's feet laterally relatively to the assemblies. On the preferred embodiment 100, these so-called "assemblies" include the crank rollers 133 and 134, the rails 143 and 144, the rocker links 163 and 164, and the drawbar links 173 and 174, all of which are present on the prior art machine reference above.

Persons skilled in the art will recognize that the subject present invention may also be described in terms of methods with reference to the foregoing embodiments. For example, the present invention may be described in terms of a method of modifying an elliptical motion exercise machine of a type having a frame configured to rest on a floor surface, left and right cranks rotatably mounted on the frame, and left and right linkage assemblies operatively interconnected between the frame and respective said cranks, including left and right rocker links that are pivotally mounted on the frame, and left and right foot supporting arrangements that guide a person's feet through respective elliptical paths. One such method comprises linking variations in angles defined between the rocker links and the foot supporting arrangements to lateral displacement of the person's feet relative to a central plane of symmetry extending perpendicular to the floor surface and lengthwise through the machine.

Persons skilled in the art will also recognize various modifications may be made to the foregoing embodiments, and that the principles of the present invention may be applied to other known embodiments of elliptical exercise machines, as well. In view of the foregoing, the present invention should be limited only to the extent of the claims set forth below.

What is claimed is:

1. An exercise apparatus, comprising a frame configured to rest on a floor surface;

a left crank and a right crank, wherein each said crank is rotatably mounted on the frame for rotation about a common crank axis;

a left foot supporting linkage movably interconnected between the frame and the left crank in a manner that defines a generally elliptical foot path that extends across a left crank plane extending through the left crank and perpendicular to the common crank axis; and a right foot supporting linkage movably interconnected between the frame and the right crank in a manner that defines a generally elliptical foot path that extends across a right crank plane extending through the right crank and perpendicular to the common crank axis, wherein each said foot supporting linkage includes a roller rotatably mounted on a respective said crank, a rocker link pivotally mounted on the frame, a rail operatively interconnected between a respective said roller and a respective said rocker link, a first drawbar operatively interconnected between a respective said crank and a respective said rocker link, a foot support movably mounted on a respective said rail, and a second drawbar operatively interconnected between a respective said rocker link and a respective said foot support.

2. The exercise apparatus of claim 1, further comprising left and right handles, wherein each of the handles is mounted on an upper distal end of a respective said rocker link.

3. The exercise apparatus of claim 1, further comprising means for adjusting each said second drawbar relative to a respective said rocker link.

4. The exercise apparatus of claim 1, wherein a forward portion of each said foot support is pivotally connected to a respective said rail for pivoting about a respective axis that extends perpendicular to the common crank axis.

5. An exercise apparatus, comprising:

a frame configured to rest on a floor surface;

a left crank and a right crank, wherein each said crank is rotatably mounted on the frame for rotation about a common crank axis;

a left foot supporting linkage, including a left foot platform, movably interconnected between the frame and the left crank in a manner that links rotation of the left crank to movement of the left foot support through a first generally elliptical foot path, including a first path position, wherein the left foot platform is disposed entirely to one side of a plane of symmetry extending perpendicular to the crank axis, and a second path position, wherein the left foot platform is intersected by the plane of symmetry;

a right foot supporting linkage, including a right foot platform, movably interconnected between the frame and the right crank in a manner that links rotation of the right crank to movement of the right foot support through a second generally elliptical foot path, including a first path position, wherein the right foot platform is disposed entirely to one side of the plane of symmetry, and a second path position, wherein the right foot platform is intersected by the plane of symmetry, wherein the left crank and the right crank rotate together about the axis to contemporaneously move each said foot support through a respective said foot path, wherein each said foot supporting linkage includes a roller rotatably mounted on a respective said crank, a rocker link pivotally mounted on the frame, a rail operatively interconnected between a respective said roller and a respective said rocker link, wherein each said foot platform is movably mounted on a respective said rail, a first drawbar operatively interconnected between a respective said crank and a respective said rocker link, and a second drawbar operatively interconnected between a respective said rocker link and a respective said foot support.

6. The exercise apparatus of claim 5, further comprising left and right handles, wherein each of the handles is mounted on an upper distal end of a respective said rocker link.

7. The exercise apparatus of claim 5, further comprising means for adjusting each said second drawbar relative to a respective said rocker link.

8. The exercise apparatus of claim 5, wherein a forward portion of each said foot platform is pivotally connected to a respective said rail for pivoting about a respective axis that extends perpendicular to the common crank axis.

9. An exercise apparatus, comprising:

a frame configured to rest on a floor surface;

a left crank and a right crank, wherein each said crank is rotatably mounted on the frame;

a left roller and a right roller, wherein each said roller is rotatably mounted on a respective said crank;

a left rocker link and a right rocker link, wherein each said rocker link is pivotally mounted on the frame;

a left foot supporting arrangement and a right foot supporting arrangement, wherein each said foot supporting arrangement includes a foot platform, and is movably interconnected between a respective said crank and a respective said rocker link;

a left first drawbar link and a right first drawbar link, wherein each said first drawbar link is movably interconnected between a respective said crank and a respective said rocker link in a manner that links rotation of each said crank to pivoting of each said rocker link and elliptical movement of each said foot platform; and a left second drawbar link and a right second drawbar link, wherein each said second drawbar link is movably interconnected between a respective said rocker link and a respective said foot supporting arrangement in a manner that links rotation of each said crank to lateral movement of each said foot platform about a respective axis extending generally perpendicular to an axis of rotation defined by at least one said crank.

10. The exercise apparatus of claim 9, wherein a respective roller is rotatably mounted on an intermediate portion of each said foot platform, and is rotatable across a respective said rail.

11. The exercise apparatus of claim 9, further comprising left and right handles, wherein each of the handles is mounted on an upper distal end of a respective said rocker link.

12. The exercise apparatus of claim 9, further comprising means for adjusting each said second drawbar relative to a respective said rocker link.

* * * * *